US007264697B2

(12) United States Patent
Ali et al.

(10) Patent No.: US 7,264,697 B2
(45) Date of Patent: Sep. 4, 2007

(54) MARINE ANODE WITH CURRENT TESTER

(75) Inventors: Mohammed Ali, Walnut Creek, CA (US); J. Darby Howard, Jr., Walnut Creek, CA (US); Chris Lisson, Walnut Creek, CA (US)

(73) Assignee: California Corrosion Concepts, Inc., Walnut Creek, CA (US)

( * ) Notice: Subject to any disclaimer, the term of this patent is extended or adjusted under 35 U.S.C. 154(b) by 260 days.

(21) Appl. No.: 10/950,200

(22) Filed: Sep. 24, 2004

(65) Prior Publication Data

US 2006/0065550 A1 Mar. 30, 2006

(51) Int. Cl.
*C23F 13/00* (2006.01)

(52) U.S. Cl. ..... 204/196.11; 204/196.06; 204/196.07; 204/196.21; 204/196.22; 204/196.23; 204/196.24; 204/196.25; 204/196.26; 204/196.19; 204/196.36

(58) Field of Classification Search ..... 204/196.06, 204/196.07, 196.11, 196.21, 196.26, 196.36, 204/196.23, 196.24, 196.25, 196.19, 196.22
See application file for complete search history.

(56) References Cited

U.S. PATENT DOCUMENTS

| | | | | |
|---|---|---|---|---|
| 3,953,742 | A | 4/1976 | Anderson et al. | |
| 4,322,633 | A | 3/1982 | Staerzl | |
| 4,710,644 | A * | 12/1987 | Baach | 204/196.36 |
| 5,384,020 | A | 1/1995 | Oppermann et al. | |
| 5,627,414 | A | 5/1997 | Brown et al. | |
| 5,716,248 | A | 2/1998 | Nakamura | |
| 5,747,892 | A | 5/1998 | Staerzl | |
| 6,183,625 | B1 | 2/2001 | Staerzl | |
| 6,228,238 | B1 | 5/2001 | Kuragaki | |
| 6,547,952 | B1 | 4/2003 | Staerzl | |
| 6,809,506 | B2 * | 10/2004 | Thomas et al. | 324/71.1 |
| 6,841,059 | B1 * | 1/2005 | Staerzl | 205/727 |

* cited by examiner

*Primary Examiner*—Bruce F. Bell
(74) *Attorney, Agent, or Firm*—Charles L. Thoeming

(57) ABSTRACT

A sacrificial marine anode with a water proof encased current tester to alert an operator of proper connectivity, current status of the cathodic protection system for an associated marine structure, and status of current tester power supply is disclosed.

16 Claims, 3 Drawing Sheets

MARINE ANODE WITH CURRENT TESTER

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention is generally related to a supplemental cathodic protection system for submersed metal portions of marine structures to mitigate corrosion thereto and to prolong the life of existing anodes installed on the structures.

2. Description of the Related Art

A search of the prior art located the following United States patents which are believed to be representative of the present state of the prior art: U.S. Pat. No. 6,547,952 B1, issued Apr. 15, 2003, U.S. Pat. No. 6,228,238 B1, issued May 8, 2001, U.S. Pat. No. 5,384,020, issued Jan. 24, 1995, U.S. Pat. No. 5,747,892, issued May 5, 1998, U.S. Pat. No. 5,716,248, issued Feb. 10, 1998, U.S. Pat. No. 5,627,414, issued May 6, 1997, U.S. Pat. No. 4,322,633, issued Mar. 30, 1982, and U.S. Pat. No. 3,953,742, issued Apr. 27, 1976.

BRIEF SUMMARY OF THE INVENTION

Corrosion is an electrochemical process accompanied by the flow of electrical current. Corrosion occurs when the following elements are present: an electrolyte or medium which conducts current by ion flow, such as water; an anode or metal which corrodes to protect another metal, such as a propeller shaft, rudder, or hull on a boat; a cathode or metal which is protected by another metal, such as bronze and stainless steel fittings on a boat; and a metallic pathway or medium which conducts current by electron flow, such as the hull, bonding systems, electrical systems on a boat.

Galvanic corrosion is the most common form of corrosion that attacks the integrity of boating structures and marine equipment. Galvanic corrosion develops when different types of metals are electrically common by submersion into water. For example, if a boat equipped with a steel rudder that is bonded to a bronze or stainless steel fitting is placed into water, the steel rudder will corrode. The steel rudder becomes the anode, while more noble metals such as bronze or stainless steel become cathodes. The water acts as the electrolyte. The metallic path is the metallic hull of the boat or the boat's bonding system.

Cathodic protection is the process of reversing the corrosion current to stop the damaging corrosion process. One type of cathodic protection known as galvanic cathodic protection is achieved by placing a type of metal into the water with the boat and connecting it to the boat's metallic parts. Metals such as aluminum or zinc are less noble than the other boat metals and therefore act as anodes when connected to the metal parts of the boat.

Zinc anodes have been long used for mitigating corrosion on metal marine structures. These devices typically consist of a bare ingot of zinc mounted to the hull, propeller shaft or rudder, or similar metallic elements of a boat. These anodes are designed to provide protection from galvanic corrosion on the boat. Additionally, bare zinc anodes attached to a long wire that comprises a clamp at the unattached end have been used to supplement the mounted zinc anode systems.

Anodes of the art do not provide replaceable anode elements or protective casings to house the anode during use. Likewise, anodes in the art do not provide current monitoring circuitry to ensure proper deployment or attachment to provide adequate protective cathodic current flow protection to the metal marine structures.

It is therefore desirable to provide an improved apparatus for supplemental cathodic protection of submerged metal portions of marine structures to mitigate corrosion thereto which provides a combined anode and current tester.

It is an object of the present invention to provide an improved anode and current tester which indicates when the anode has been deployed correctly and a connection to the submerged metal portions of a marine structure is made in a satisfactory manner.

It is a further objective of the present invention to provide an improved anode and current tester which indicates when protective cathodic protection current is flowing.

It is still a further objective of the present invention to provide an improved anode and current tester which is easily installed and used by a lay operator.

It is yet a further objective of the present invention to provide an improved anode and current tester apparatus which does not damage surfaces that come in contact with the apparatus.

Yet another object of the present invention is to provide an improved anode and current tester apparatus which will prolong the life of existing anodes installed on marine structures.

The apparatus of the present invention consists of a replaceable anode element and a current tester element. The anode element comprises a cylindrical anode element consisting of a marine grade alloy selected from the group consisting of aluminum, magnesium, zinc, or the like.

The replaceable anode is housed inside a slotted plastic casing. The slotting provides contact between the anode and an electrolyte, such as seawater. The casing protects the anode and the metal marine structure from damage resulting from their contact due to wave action, or damage resulting from the anode contacting others surfaces, namely dropping the anode onto a surface such as a boat deck.

The current tester is housed inside a water proof enclosure. It comprises different colored light emitting diode (LED) lamps or other similar light sources to serve as self check mechanism for proper connection and adequate flow of cathodic protection current. By depressing a switch on the current tester, the operator is alerted as to whether or not the anode has been deployed correctly and attached to the metal marine structure in a satisfactory manner to register a resultant flow of protective cathodic protection current.

Other features, advantages, and objects of the present invention will become apparent with reference to the following description and accompanying drawings.

DETAILED DESCRIPTION OF THE INVENTION

The present invention combines a marine anode housed within an anode casing which allows anode contact with an electrolyte when the casing is submerged within the electrolyte. The anode is disposed in noncontact association with a metal structure to be protected by a wire of suitably coated and insulated materials. Circuitry housed in a water proof casing is connected in series with the anode and metal structure by attachment to the wire. This circuitry has a self-contained direct current power source, and provides the operator with switched testing of current strength, proper connectivity of the marine anode, and flow of cathodic protection current. Once an anode has been corrosively consumed, it is easily replaced within the anode casing by a new anode of like material.

Figure 1:
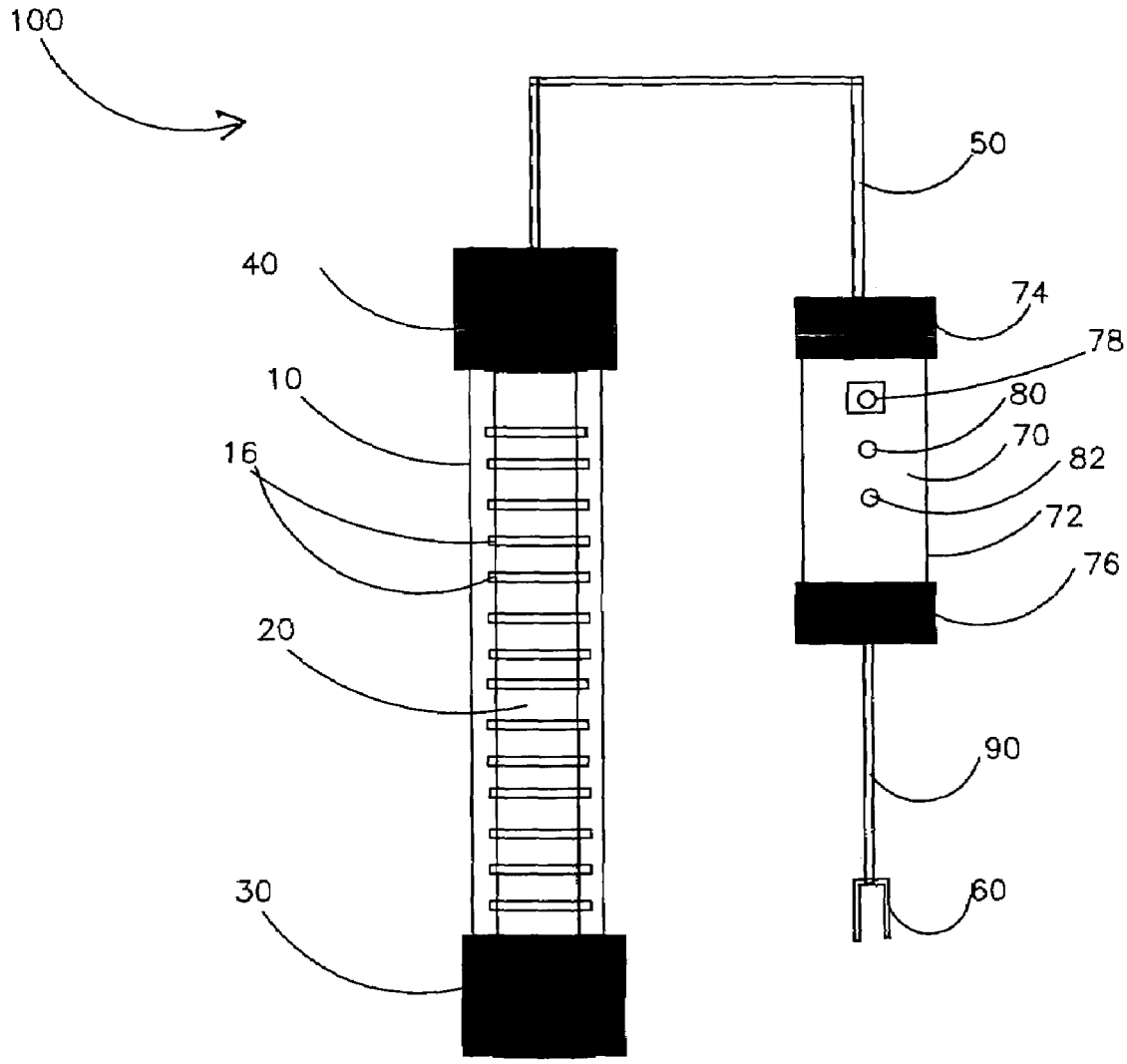
FIG. 1 is a not to scale depiction of the elements of an embodiment of the present invention.

As shown in FIG. 1, a preferred embodiment of the present invention 100 comprises a 1.5 inch diameter by 12 inch or 24 inch long slotted or otherwise perforated, cylindrical anode casing 10 housing a detached 1.2 inch diameter by 12 inch or 24 inch long replaceable anode element 20. The anode element is made from a marine grade alloy material selected from the group consisting of aluminum, magnesium, zinc, or the like. The slotted casing 10 has a plurality of slotted openings 16, or similar access, along the casing wall to allow free flow of electrolyte through the casing slots or openings and provide electrolytic contact with the housed anode element 20. The slotted casing 10 is further defined by one open, threaded end to receive a threaded cap 40 for easy anode access and replacement. The other end of the slotted casing 10 is closed by a permanent cap 30. The anode casing 10, and the caps 30 and 40 are made from durable grade polyvinylchloride, or similar materials, suitable for withstanding moderate external impact and the internal forces of the metal anode in turbulent electrolytic environments. The anode casing 10 with caps 30 and 40 thus provides protection from the anode impacting decking surfaces or boat sidewalls while in use.

Figure 2:
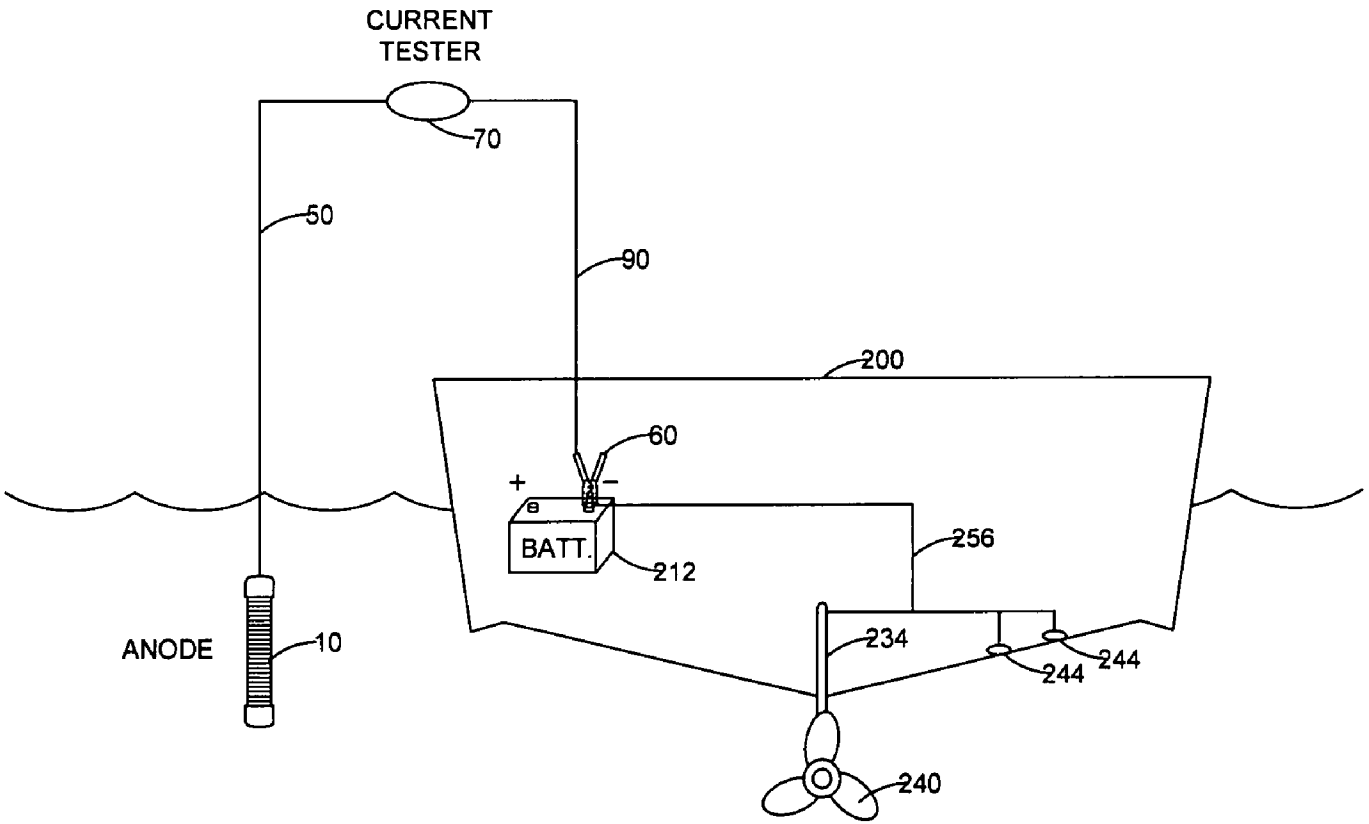
FIG. 2 is a not to scale depiction of one application of an embodiment of the present invention connected to the cathodic protection circuit of a marine vessel.

The anode assembly of a preferred embodiment of the present invention, FIGS. 1 and 2, is supplied with a ⅛ inch diameter vinyl coated, stainless steel/insulated copper wire in two lengths. One wire length 50 which connects the anode element 20 to the current tester 72 is approximately twenty-five feet in length. The second wire length 90 connects the current tester 72 to a stainless steel connector 60 for connection to a metal marine structure bonding or cathodic protection system. The stainless steel connector 60 for a preferred embodiment of the present invention is an alligator type clamp. The second wire length can be tailored for the operator's convenience, but it typically ranges from approximately eighteen to twenty-four inches.

The threaded cap 40 on one end of the slotted or otherwise perforated anode casing 10 provides access for the attachment of the vinyl coated, stainless steel/insulated copper wire 50 to one end of the anode element 20 through an opening in the threaded cap end.

When an anode is corrosively consumed or otherwise ceases to provide adequate cathodic protection, it is easily replaced by another anode of like material by insertion into the slotted or otherwise perforated anode casing 10. This process requires only the opening of the anode casing 10 at the threaded cap 40 end of the anode casing 10 by removal of the threaded cap 40. The threaded end cap is positioned a distance along the copper wire 50 through the opening in the cap end. The consumed anode is detached from the vinyl coated, stainless steel/insulated copper wire 50, which is in turn connected to one end of the new or replacement anode element 20. One end of the new or replacement anode element 20 is attached to the copper wire 50. The replacement anode element 20 with copper wire 50 attached is then inserted into the anode casing 10 along the casing's longitudinal axis. The threaded cap 40 is re-secured to the anode casing 10 and the apparatus of the present invention is ready to be reapplied to the marine structure to provide supplemental cathodic protection.

Figure 3:
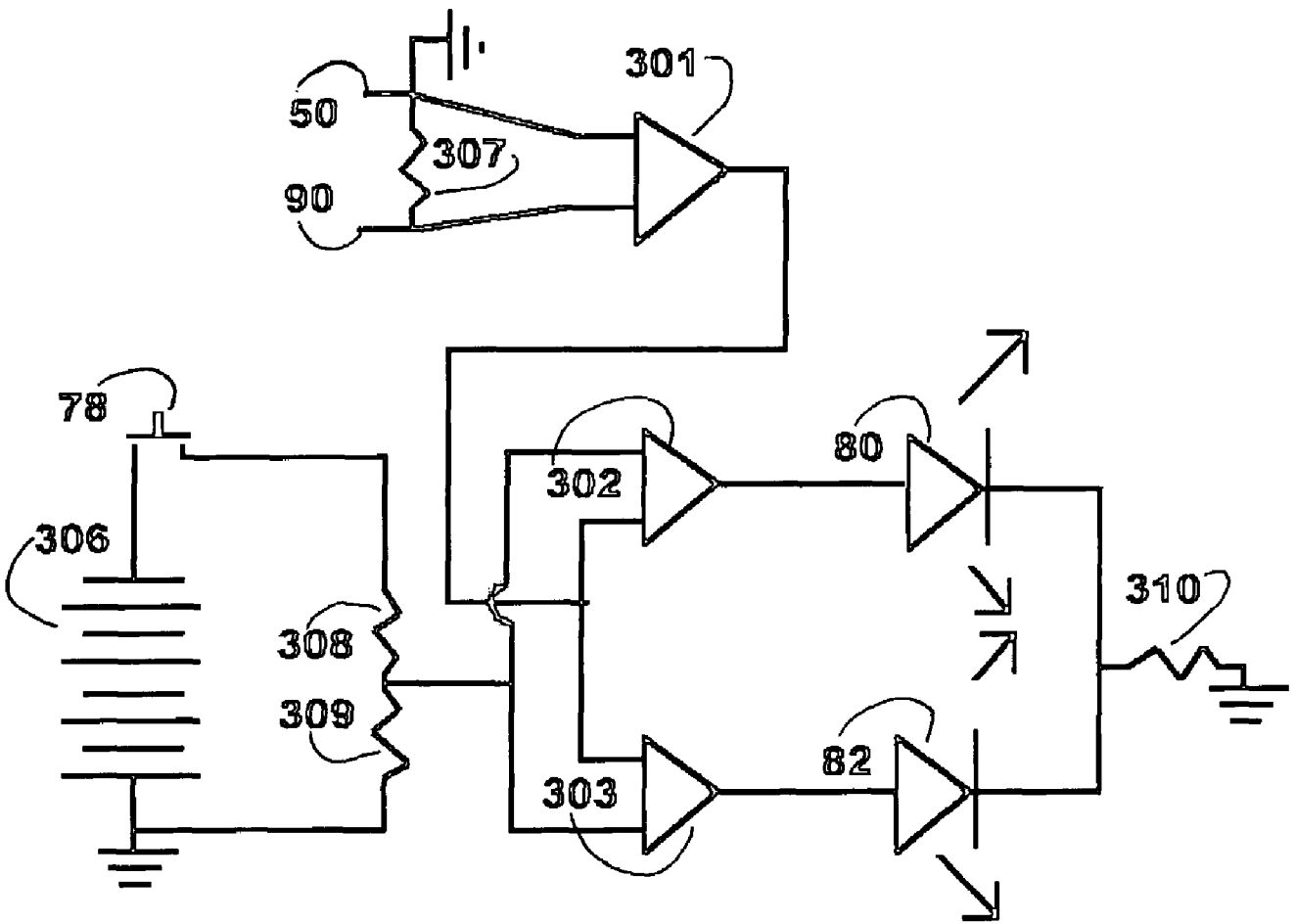
FIG. 3 is an electrical schematic of a circuit suitable for the current tester element of an embodiment of the present invention.

As further depicted in FIGS. 1 and 3, the current tester 70 of the present invention is installed in series with the anode assembly near the clamp end of the wire. The current tester 70 is housed inside a 1 inch diameter by 4 inch length of transparent vinyl tubing 72 with two plastic, water proof end caps 74 and 76. It is critical to the proper function of the present invention that the sides of the vinyl tubing 72 provide sufficient compression pliability to allow an operator to depress the switch 78 of the current tester circuitry by squeezing the tubing 72 from the exterior of the tubing walls. This external activation of the switch 78 allows the operator to confirm the adequacy of the current tester circuitry power supply, connectivity of the anode and current tester, and current flow to the intended structure(s). The preferred embodiment of the present invention uses an internal, direct current battery pack 306 depicted generally in FIG. 3, as its power supply. One end cap 74 provides water proof access from the length of vinyl coated, stainless steel/insulated copper wire 50 which is attached to one end of the anode element 20. The other end cap 76 provides water proof access from the length of vinyl coated, stainless steel/insulated copper wire 50 which is attached to one end of the anode element by an alligator type clamp 60 with insulated handles. The current tester 70 is thus made water proof when enclosed within the capped, vinyl tubing housing.

The tester further comprises the necessary electronic circuitry used to detect cathodic protection current flow from the anode to the metal marine structure to be protected. Housed with the tester within the water proof assembly described above is the current supply for the electronic circuitry. The tester provides a manual switch 78 accessible from the housing exterior by operator applied pressure and a red LED signal 80 to check the current tester battery life, FIGS. 1 and 3. The tester further provides a green LED signal 82 to check if the proper connection is made to the metal marine structure to be protected and if a flow of cathodic protection current of 5 mA or greater is detected, FIGS. 1 and 3.

FIG. 2 depicts use of an embodiment of the apparatus of the present invention to provide protection to the rear portion of a marine structure, 200, having a stern drive unit 234 with propeller 240. The wire portion 50 of at least one apparatus of the present invention is secured to the unsubmerged portion of the structure so that at least one housed anode portion 10 hangs three to four feet below the bottom of the submerged portion of the structure, 200. In this fashion, the housed anode is within the electrolyte solution, but reamins above any mud or vegetation present in, and any sea floor or similar bottom surface below, the electrolyte.

As shown in FIG. 2, the current tester 70 is connected in series to the vessel's battery 212 at the negative post and the anode 10 by lengths of vinyl coated, stainless steel/insulated copper wire, 90 and 50, respectively. An alligator type clamp connector 60 secures the length of wire from the tester 70 to the battery 212. The marine vessel's stern drive unit 234 is grounded to the hull 244 and connected to the battery 212 by line 256. The housed anode portion 10 is disposed in noncontact association with the metal elements of the marine structure 200 to be protected.

FIG. 3 is an electrical schematic of a circuit suitable for performing the current testing functions of the present invention. In the following description of FIG. 3, the component values and identification refer to one particularly preferred embodiment of the circuit and are not limiting to the present invention. As well understood by those in the art, the absolute magnitudes of the components and the particular types of components used in the circuit of FIG. 3 can be changed without adversely affecting the operation of the present invention as long as certain relationships and characteristics of the components are maintained.

FIG. 3 shows the line from the anode 50 and the line from the structure to be protected 90. The operator then applies pressure to the transparent portion of the current tester to depress the internal switch or push button 78.

As the button 78, a normally open push button switch, is pressed, current flows from the battery 306 into the test circuit. A voltage divider consisting of two resistors, 308 and 309, divides voltage from the battery 306 to a pre-set reference voltage. The switch 78 also provides power to the lm324 type operational amplifiers, 301-303. Three of the four operational amplifiers built into the lm324 type chip, 301-303, are used in this embodiment of the present invention. The first, 301, as a primary stage comparator across the shunt resistor 307 to detect current flow. Its output is fed into the second two switch stage operational amplifiers, 302 and 303, amplifying the signal to determine its value relative the reference voltage. If the output value is below the reference voltage, one of the operational amplifiers 302 is switched to high, and the other 303 is low. If the output value is above the reference voltage, these operational amplifier switched values are reversed. This embodiment of a circuitry suitable for the present invention is wired such that if the output of the primary stage operational amplifier 301 is below the reference voltage, the red LED 80 is illuminated and the green LED is not illuminated. If the output of the primary stage operational amplifier 301 is above the reference voltage, the red LED 80 is not illuminated and the green LED is illuminated. The switching point or current detection threshold is determined by the values and placement of the voltage divider resistors, 308 and 309, and the value of the shunt resistor 307. A current limiting resistor 310 is in series with the LED's, 80 and 82, to prolong battery 306 and LED life.

Prior to anode deployment, a red LED 304 glow indicates that the current tester power supply 306 is adequate but that no current is flowing through the anode 10, FIGS. 2 and 3. After anode deployment, i.e., FIG. 2, the operator again applies pressure to the transparent portion of the current tester to depress the internal switch or push button 78. A green LED 305 glow indicates current flow through the anode 10, signifying proper apparatus connection to the vessel 200 and operation of the anode circuitry. In the present circuitry, the green LED 305 lights up at about 5 mA. One or more LED's of different colors can be added to this circuitry (not shown), triggered by differing current levels to indicate the level of current output from the anode.

Accordingly, an improved marine anode with current tester has been disclosed.

With respect to the above description then, it is to be understood and realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings, circuit schematics, and described in the specification are intended to be encompassed by the present invention.

A latitude of modification, change and substitution is intended in the foregoing disclosure, and in some instances some features of the invention will be employed without a corresponding use of other features. Therefore, it is appropriate that the appended claims be considered broadly and in a manner consistent with the spirit and scope of the invention disclosed herein.

We claim:

1. A marine anode with current tester, comprising:

an anode;

means for housing the anode to prevent the anode from scratching a marine structure surface;

vinyl coated steel or insulated copper wire connecting the anode to a stainless steel clamp assembly to attach the anode to the marine structure;

circuitry assembly for current testing connected in series with the anode and the marine structure, the assembly housed in a water proof enclosure complete with power supply.

2. The apparatus of claim 1, wherein the anode comprises a cylinder of predetermined length and uniform cross-sectional area, and further comprising material selected from the group consisting of zinc, aluminum, and magnesium.

3. The apparatus of claim 1, wherein means for housing the anode comprises:

means for slotted cylindrical casing with two ends wherein one end is threaded and the other end is permanently capped, having a longitudinal axis, and sized to insertably receive in the casing threaded end an anode with attached connecting wire whereby the housed anode is capable of contacting an electrolyte when the casing is submerged into the electrolyte; and means for capping the casing threaded end.

4. The apparatus of claim 1, wherein vinyl coated steel or insulated copper wire connecting the anode to a stainless steel clamp assembly is used to attach the anode to the marine structure further comprises:

two predetermined lengths of vinyl coated stainless steel/insulated copper wire, each wire length having the same diameter and two ends, wherein one wire length end is attached to the anode; and means to attach one wire end of the wire length not attached to the anode to the marine structure to be protected;

wherein circuitry assembly for current testing is connected to the unattached wire ends, whereby the circuitry assembly is attached in series between the anode and the marine structure to be protected.

5. The apparatus of claim 4, wherein the clamp assembly comprises a stainless steel alligator type clamp attached to the wire end leading from the circuitry assembly, and further comprises two insulated handles.

6. The apparatus of claim 4, wherein the length of wire between the anode and circuitry assembly comprises a ⅛ inch diameter and a 25 foot length.

7. The apparatus of claim 4, wherein the length of wire between the circuitry assembly and means to attach one wire end to the marine structure to be protected comprises a ⅛ inch diameter and a 1.5 foot length.

8. The apparatus of claim 4, wherein circuitry means for current testing comprises means for testing current flow.

9. The apparatus of claim 4, wherein circuitry means for current testing comprises means for testing connectivity.

10. The apparatus of claim 4, wherein circuitry means for current testing comprises means for testing circuitry means power supply.

11. The apparatus of claim 4, wherein water proof means for housing current testing circuitry comprises flexible transparent material.

12. The apparatus of claim 4, wherein the anode diameter is 1.2 inches and the anode length is 12 inches.

13. The apparatus of claim 4, wherein the anode diameter is 1.2 inches and the anode length is 24 inches.

14. The apparatus of claim 4, wherein circuitry assembly further comprises at least one light emitting diode indicator.

15. A kit for marine anode and current tester, the kit comprising in combination:

a cylindrical anode comprising a predetermined length, a 1.2 inch diameter defining a uniform cross-sectional area, two ends, and further comprising material selected from the group consisting of zinc, aluminum, and magnesium;

a 25 foot length of vinyl coated stainless steel/insulated copper wire having a ⅛ inch diameter and two ends wherein one wire end is attached to one anode end;

a slotted cylindrical casing comprising:

a longitudinal axis;

two ends, wherein one end is threaded and the other end is permanently capped, and wherein the casing sized to insertably receive the anode in the threaded end and house the anode within the casing, and whereby the housed anode is capable of contacting an electrolyte when the casing is submerged into the electrolyte; and means for capping the casing threaded end wherein the vinyl coated stainless steel/insulated copper wire attached to the anode end extends from the capped casing end;

current testing assembly encased in a waterproof housing comprising direct current power supply, at least one light emitting diode indicator, pressure activated test switch, and attachment assembly to the current testing assembly for the 25 foot length of vinyl coated stainless steel/insulated copper wire end not attached to the anode, whereby current testing assembly test switch can be operated by pressure applied externally to the waterproof housing and current testing assembly comprises means for testing:

direct current power supply;

connectivity; and current flow;

a second length of vinyl coated stainless steel/insulated copper wire 1.5 feet long and ⅛ inches in diameter having two ends, and attachment assembly for one end of the second wire to the current testing assembly, whereby current testing assembly is connected in series with respect to the lengths of vinyl coated stainless steel/insulated copper wire; and clamping assembly attached to the wire end not attached to current testing assembly, whereby the current testing assembly is connected to the marine structure to be protected from corrosion.

16. The kit of claim 15, wherein the anode length is from 12 to 14 inches.

* * * * *